US006990713B2

(12) United States Patent
Tally et al.

(10) Patent No.: US 6,990,713 B2
(45) Date of Patent: Jan. 31, 2006

(54) STEERING COLUMN PIVOT PIN REMOVAL TOOL

(75) Inventors: Kevin L. Tally, Clarinda, IA (US); Timothy V. Geist, Vienna, WV (US)

(73) Assignee: Lisle Corporation, Clarinda, IA (US)

( * ) Notice: Subject to any disclaimer, the term of this patent is extended or adjusted under 35 U.S.C. 154(b) by 115 days.

(21) Appl. No.: 10/767,715

(22) Filed: Jan. 27, 2004

(65) Prior Publication Data

US 2004/0211046 A1 Oct. 28, 2004

Related U.S. Application Data

(60) Provisional application No. 60/442,864, filed on Jan. 27, 2003.

(51) Int. Cl.
*B23P 19/04* (2006.01)

(52) U.S. Cl. ..... 29/264

(58) Field of Classification Search ..... 29/263, 29/264, 256, 269, 273
See application file for complete search history.

(56) References Cited

OTHER PUBLICATIONS

A-98 Catalog Copyright 1998 by SPX Corp. OTC.
MAC Tools MT99CAT © 1999 Stanley Works.
Snap-On Catalog Copyright © 1995 Snap-On.
MATCO Tools Catalog 2002-2003.

*Primary Examiner*—Robert C. Watson
(74) *Attorney, Agent, or Firm*—Banner & Witcoff, Ltd.

(57) ABSTRACT

A steering column pivot pin removal tool includes a bridge support with a jack nut having a cap screw threaded therethrough for engagement with a pivot pin of a steering assembly. The jack nut is held in place by an O-ring. Clockwise rotation of the jack nut effects withdrawal of the pivot pin engaged by the cap screw.

4 Claims, 1 Drawing Sheet

STEERING COLUMN PIVOT PIN REMOVAL TOOL

CROSS REFERENCE TO RELATED APPLICATION

This is a utility application based upon previously filed provisional application Ser. No. 60/442,864 filed Jan. 27, 2003, entitled STEERING COLUMN PIVOT PIN REMOVAL TOOL, incorporated herein by reference and for which priority is claimed.

BACKGROUND OF THE INVENTION

In a principal aspect, the present invention relates to a tool designed to remove the pivot pin of a tiltable steering wheel system.

A tilt steering wheel system typically includes a pivot pin which is positioned in the steering column of the steering wheel assembly for a vehicle. Such steering wheel assemblies are generally telescoping and tiltable steering wheel assemblies and provide for adjustment of the steering wheel to accommodate a driver of the vehicle. To service a tilt and telescoping steering column, it is desirable to utilize some type of tool that will facilitate removal of the pivot pin which is used to maintain the steering column in an assembled condition. Various prior art tools have been provided for such purpose, such as Kent-Moore Steering Pivot Pin Remover, Model No. 7886 and Model No. 7889. Another pivot pin removal tool available in the marketplace for purposes of pulling or removing steering pivot pins include Snap On Tool Tilt Steering Pivot Pin Puller Model CJ134.

While such devices work well, there has remained the need for an improved tool to effect pivot pin removal. That is, prior art tools utilize a pull screw which has a large thread at one end and a small thread on the opposite end. The smaller diameter threaded end is designed to thread into a threaded bore in the pivot pin of the steering assembly. If that threaded end breaks, which is often the situation, then a new tool or at least a new screw element must be purchased. This becomes an expensive option.

Thus there has remained the need for an improved pivot pin removal tool which overcomes some of the deficiencies of prior art tools.

SUMMARY OF THE INVENTION

Briefly, the present invention comprises a steering column pivot pin removal tool which includes a bridge support with a crown at one end and depending legs from the crown. A jack nut is fitted through a passage in the bridge support crown and is retained on the bridge support by means of an O-ring engaging the jack nut. The jack nut includes a threaded through passage through which a cap screw may be inserted. The cap screw is sized to fit into a threaded bore in the pivot pin to effect the removal of the pivot pin. Thus, the cap screw and jack nut are both independently rotatable and both mounted on the bridge support. The smaller cap screw may be threaded into the pivot pin. When so threaded in and tightly engaged with the pivot pin, then the jack nut may be rotated in a clockwise direction while holding the cap screw in a fixed position so as to effect pulling or removal of the pivot pin from the steering assembly.

Thus, it is an object of the invention to provide an improved pivot pin removal tool for steering column assemblies.

It is a further object of the invention to provide an improved pivot pin removal tool for removal of pivot pins from a steering column assembly wherein the tool is comprised of three interacting elements including a small diameter threaded cap screw fitted into a threaded jack nut which rotates within a bridge support assembly.

Yet another object of the invention to provide a pivot pin removal tool which has a simplicity of construction yet is rugged and inexpensive.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
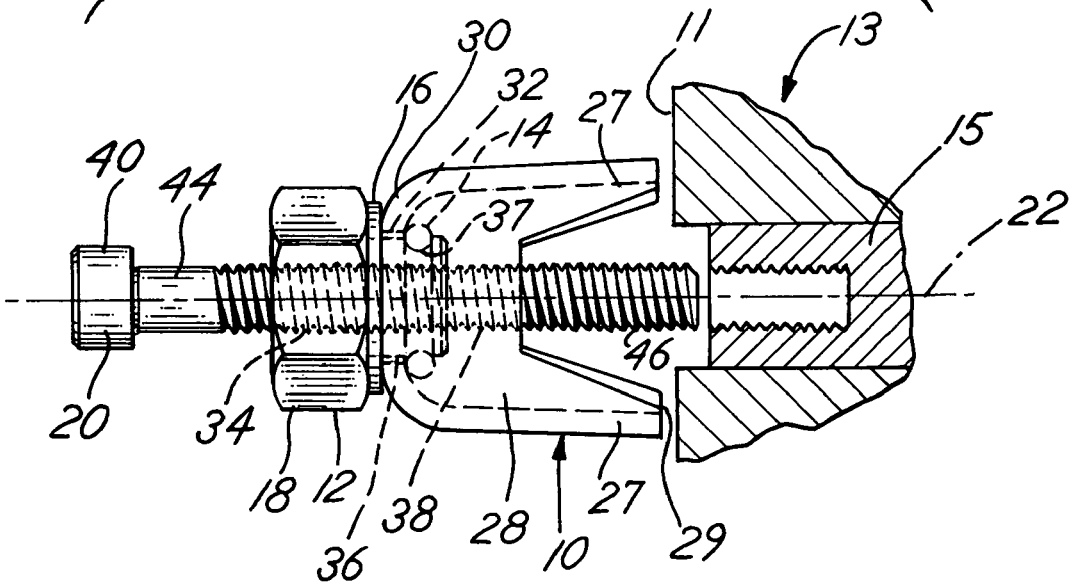
FIG. 1 is a side elevation of the improved pivot pin removal tool of the invention.
Figure 2:
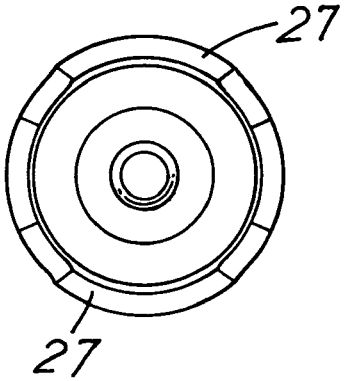
FIG. 2 is an end view of the tool of FIG. 1.
Figure 3:
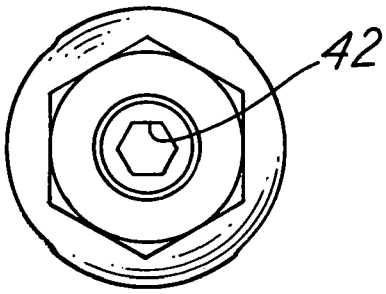
FIG. 3 is an opposite end view of the tool of FIG. 1.

Referring to the figures, the pivot pin removal tool of the invention is comprised of five basic parts namely, a cap screw 20, a jack nut 12, a washer 16, an O-ring 14, and a support or bridge support 10. The component parts are symmetrical about a longitudinal axis 22. The bridge support 10 comprises or includes a cylindrical housing 28 and depending legs 27 arranged about the axis 22. Each leg 27 terminates along a planar surface 29 so that the legs 27 will support the tool uniformly on a surface such as a surface 11 associated with a steering assembly 13 having a pivot pin 15 inserted therein. The bridge support 10 includes a through passage 32 at the crown end 30 thereof. The jack nut 12 includes a hexagonal head 18 and a projecting cylindrical, non-threaded shaft 36 with a groove 37 for receipt of O-ring 14. The jack nut 12 has a threaded axial bore 38 for receipt of the threaded end 46 of the cap screw 20.

The cap screw 20 has a recessed axial opening 42 in a head 40 for receipt of an Allen wrench to effect utilization of the pivot pin removal tool. The cap screw 20 further includes an axial shaft 44 extending from head 40 having a threaded end or shaft 46. The threaded shaft 46 is threaded through the jack nut 12 and, more particularly, threaded through the threaded section 34 of the jack nut 12. In this manner, the threaded section or shaft 46 of the cap screw 20 may be threaded into a pivot pin 15 of the steering assembly. Thereafter an Allen wrench may be inserted into the recess 42 and the jack nut 12 may then be rotated by means of a wrench to effect pulling or removal of the pivot pin 15 from the steering column assembly.

In review, the tool is used by placing the bridge support 10 legs 27 against the steering column assembly 11. The cap screw 20 is then threaded through the jack nut 12 and into the pivot pin 15. The cap screw 20 is then held in a fixed non-rotatable position and the jack nut 12 is turned in a clockwise direction. The O-ring 14 and washer 16 act as a bearing to maintain the jack nut 12 in combination with the bridge support 10 but rotatable.

With the tool of the invention, the small diameter threaded cap screw 20 may break, but in such event the entire tool need not be replaced. Rather, the cap screw 20 may merely be removed from the jack nut 12 and replaced by a separate, very inexpensive cap screw 20.

Variations of the construction may be utilized. However, the invention is to be limited only by the following claims and equivalents thereof.

What is claimed is:

1. A steering column pivot pin removal tool comprising, in combination:

a bridge support comprising a generally hollow cylindrical member having an axis with a crown at one end connecting the cylindrical side of the cylindrical member, said crown including an axial through passage;

a jack nut including a nut, an axial threaded through passage, a non-threaded shaft fitted through the bridge support through passage and a retainer spaced from the nut to retain the jack nut on the bridge support, said jack nut being rotatable relative to the bridge support; and a cap screw having a generally uniform diameter screw shaft and a cap screw head, said screw shaft axially threaded into the jack nut and extending for threadable engagement with a threaded opening of a steering column pivot pin, said cap screw, jack nut and bridge support all being independently rotatable about the axis.

2. The tool of claim 1 wherein the retainer is an O-ring in a groove in the non-threaded shaft.

3. The tool of claim 1 wherein the cylinder walls of the bridge support are discontinuous and form multiple support legs.

4. A steering column pivot pin removal tool comprising, in combination:

a bridge support comprising a generally hollow support member having a longitudinal axis with a transverse crown at one end connecting the sides of the support member, said crown including an axial through passage;

a jack nut including a nut, an axial threaded through passage, a non-threaded shaft fitted through the bridge support through passage and a retainer spaced from the nut to retain the jack nut on the bridge support, said jack nut being rotatable relative to the bridge support; and a cap screw having a generally uniform diameter screw shaft and a cap screw head, said screw shaft axially threaded into the jack nut and extending for threadable engagement with a threaded opening of a steering column pivot pin, said cap screw, jack nut and bridge support all being independently rotatable about the axis.

* * * * *